US005715862A

United States Patent [19]

Palmer

[11] Patent Number: 5,715,862

[45] Date of Patent: Feb. 10, 1998

[54] BIDIRECTIONAL FLOW CONTROL DEVICE

[75] Inventor: John M. Palmer, Cicero, N.Y.

[73] Assignee: Carrier Corporation, Syracuse, N.Y.

[21] Appl. No.: 758,128

[22] Filed: Nov. 25, 1996

[51] Int. Cl.[6] ..... F16K 17/26

[52] U.S. Cl. ..... 137/493.8; 137/493; 62/324.6

[58] Field of Search ..... 137/493, 493.8, 137/493.9; 62/324.6

[56] References Cited

U.S. PATENT DOCUMENTS

| | | | |
|---|---|---|---|
| 5,025,640 | 6/1991 | Drucker | 137/493.8 |
| 5,038,579 | 8/1991 | Drucker | 137/493.9 |
| 5,052,192 | 10/1991 | Drucker | 137/493.8 |
| 5,341,656 | 8/1994 | Rust | 62/324.6 |
| 5,345,780 | 9/1994 | Aaron et al. | 62/324.6 |
| 5,507,468 | 4/1996 | Evans | 137/513.3 |

*Primary Examiner*—Denise L. Ferensic
*Assistant Examiner*—Ramyar M. Farid

[57] ABSTRACT

A device for controlling or metering fluid flow in either direction through a conduit. The device comprises an elongated body having two end walls forming an internal chamber therebetween. Each end wall further having an aperture extending axially therethrough. Disposed within the chamber is a free floating piston having a first metering orifice and a second metering orifice extending therethrough. Fluid flow through the device urges the piston against the end wall in the direction of fluid flow. In this position, the end wall in the direction of fluid flow closes off the second metering orifice while fluid is permitted to pass through the first metering orifice and into the aperture in the end wall in the direction of fluid flow. Upon a flow reversal, the piston is urged against the opposite end wall. In this position, fluid will flow through the second metering orifice in the piston and exit into the aperture in the end wall in the direction of fluid flow. The device is adapted for use in a reversible vapor compression air conditioning system. In this application, the sizes of the two metering orifices are different so that one can provide proper metering for cooling mode operation and the other can provide proper metering for heating mode operation.

5 Claims, 2 Drawing Sheets

BIDIRECTIONAL FLOW CONTROL DEVICE

BACKGROUND OF THE INVENTION

This invention relates generally to devices for controlling the flow of a fluid within a conduit. More particularly, the invention relates to a device that is capable of controlling the expansion of a fluid, such as a refrigerant for example, in either flow direction through the device. An application for such a device is in a reversible vapor compression air conditioning system, commonly known as a heat pump.

Reversible vapor compression air conditioning systems are well known in the art. A conventional heat pump system has a compressor, a flow reversing valve, an outside heat exchanger, an inside heat exchanger and one or more expansion means for metering flow, all connected in fluid communication in a closed refrigerant flow loop. The inside heat exchanger is located in the space to be conditioned by the system and the outside heat exchanger is located outside the space to be conditioned and usually out of doors. The flow reversing valve allows the discharge from the compressor to flow first to either the outside heat exchanger or the inside heat exchanger depending on the system operating mode. When the heat pump system is operating in the cooling mode, refrigerant flows first through the inside heat exchanger, which functions as a condenser and then through the outside heat exchanger, which functions as an evaporator. When the heat pump system is operating in the heating mode, the reversing valve is repositioned so that refrigerant flows first through the outside heat exchanger and the functions of the two heat exchangers are reversed as compared to cooling mode operation.

All vapor compression refrigeration or air conditioning systems require an expansion or metering device in which the pressure of the refrigerant is reduced. In nonreversing systems, the expansion device need only be capable of metering the flow in one direction. In heat pumps and other reversible systems, the refrigerant must be in both refrigerant flow directions. It is not to use a sin capillary tube or orifice in a reversible system, as the metering requirement during cooling mode operation is not equal to the requirement during heating mode operation. A simple capillary or orifice optimized for operation in one mode would give poor performance in the other mode. One known method of achieving the requirement for proper flow metering in both directions is to provide dual metering devices in the refrigerant flow loop between the two heat exchangers. The first metering device, a flow control device such as a capillary or orifice, is installed so that it can meter refrigerant flowing from the inside heat exchanger to the outside heat exchanger (cooling mode). The second metering device, which is similar to the first metering device but optimized for operation in the heating mode, is installed so that it can meter refrigerant flowing from the outside heat exchanger to the inside heat exchanger (heating mode). Check valves are installed in bypass lines around the metering devices and in such an alignment so that refrigerant flow can bypass the first metering device during cooling mode operation and bypass the second metering device during heating mode operation. This arrangement is satisfactory from an operational perspective but is relatively costly as four components are required to achieve the desired system flow characteristics.

It is known in the art to combine in one device the functions of metering in one flow direction and offering little or no restriction to flow in the other. Such a device is disclosed in U.S. Pat. No. 3,992,898. In such a system, two such devices are installed in series in the refrigerant flow loop between the heat exchangers. The first metering device allows free refrigerant flow from the inside heat exchanger to the outside heat exchanger and meters refrigerant flow in the opposite direction to provide optimum metering capacity during cooling mode operation. The second metering device allows free refrigerant flow from the outside heat exchanger to the inside heat exchanger and meters refrigerant flow in the opposite direction to provide optimum metering capacity during heating mode operation. U.S. Pat. No. 4,926,658 discloses the use of a two way flow control device in a reversible vapor compression air conditioning system. As disclosed therein, this flow control device meters the flow of refrigerant in both directions, however it relies on a separate check valve in combination with a conventional expansion valve to properly condition the fluid for the appropriate cycle.

SUMMARY OF THE INVENTION

The present invention is a flow control device that will properly meter fluid, such as refrigerant in its gaseous state as utilized in a reversible vapor compression system, flowing in either direction through the device. In particular, the device allows different metering characteristics for each direction.

The flow control device includes a body having a first end wall, a second end wall, and a chamber formed therebetween. Each end wall further having an aperture passing therethrough and communicating with the chamber which is coaxially formed within the body between the spaced apart walls. A free floating piston is slidably mounted within the chamber and adapted to move in response to and in the direction of flow passing through the chamber between the first and second end walls. The piston includes a first metering orifice and a second metering orifice extending therethrough in such a manner that the first metering orifice communicates with aperture in the first end wall in the direction of fluid flow and the second metering orifice is closed off by the first end wall against which the piston is moved by fluid flow. When the fluid flow is in a first direction the piston is moved in the first direction against the first end wall. The fluid flows through the first metering orifice in the piston whereby a metered quantity of fluid is throttled and passed through to the aperture in the first end wall. In this position the second metering orifice is closed off from communication with the first aperture by the first end wall. When the flow of fluid through the device is reversed, the piston is moved in the opposite second direction and comes into contact with the second end wall, closing off the first metering orifice in the piston and causing the fluid to flow through the second metering orifice in the piston. The size of the metering orifices in the piston are sized to provide the proper metering of fluid flow in the respective direction of fluid flow.

BRIEF DESCRIPTION OF THE DRAWINGS

The accompanying drawings form a part of the specification. Throughout the drawings, like reference numbers identify like elements.

DESCRIPTION OF THE PREFERRED EMBODIMENTS

Figure 1:
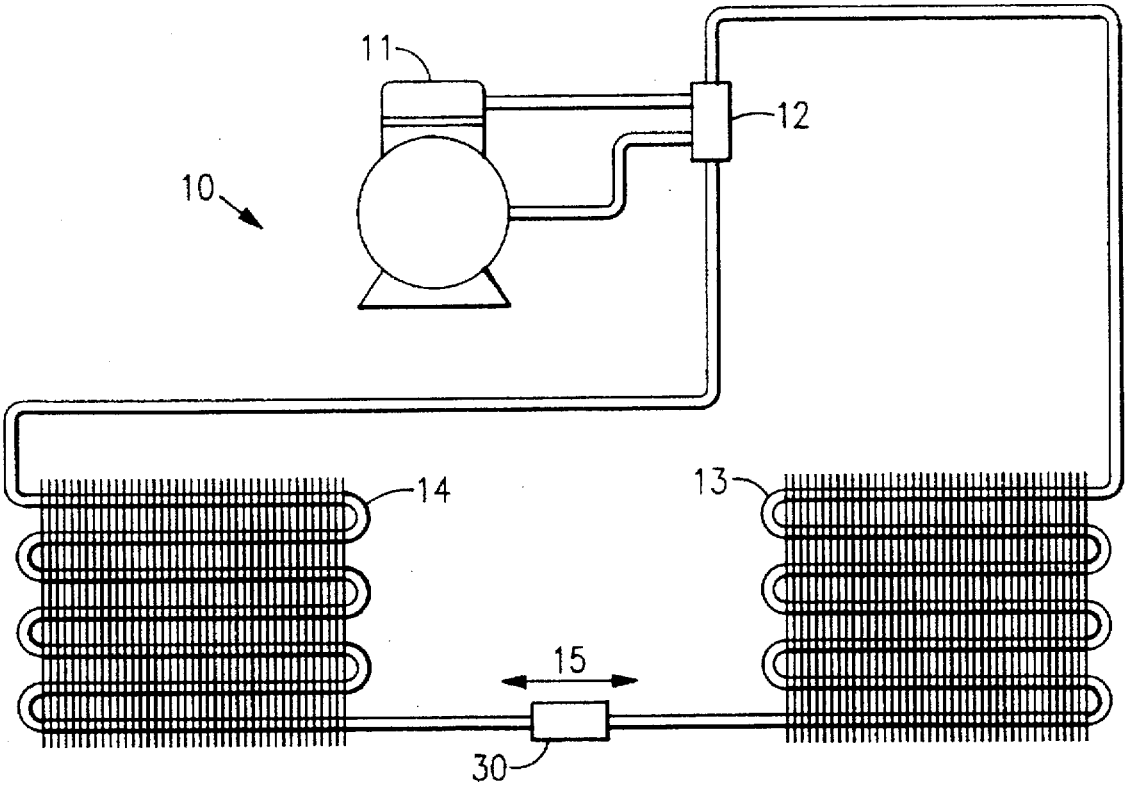
FIG. 1 is a schematic representation of a reversible vapor compression air conditioning system employing the flow control device of the present invention.

Referring to FIG. 1, there is illustrated a reversible vapor air conditioning system for providing either heating or cooling incorporating the bidirectional fluid control device 30 of the present invention. The system basically includes a first heat exchanger unit 13 and a second heat exchanger unit 14. In a cooling mode of operation the fluid flow 15 is from left to right. As a result heat exchanger 14 functions as a conventional condenser within the cycle while heat exchanger 13 performs the duty of an evaporator. In the cooling mode of operation the fluid, refrigerant, passing through the supply line is throttled from the high pressure condenser 14 into the low pressure evaporator 13 in order to complete the cycle. When the system is employed as a heat pump the direction of the refrigerant flow is reversed and the function of the heat exchangers reversed by throttling refrigerant in the opposite direction. The flow control device of the present invention is uniquely suited to automatically respond to the change in refrigerant flow direction to provide the proper throttling of refrigerant in the required direction.

Figure 2:
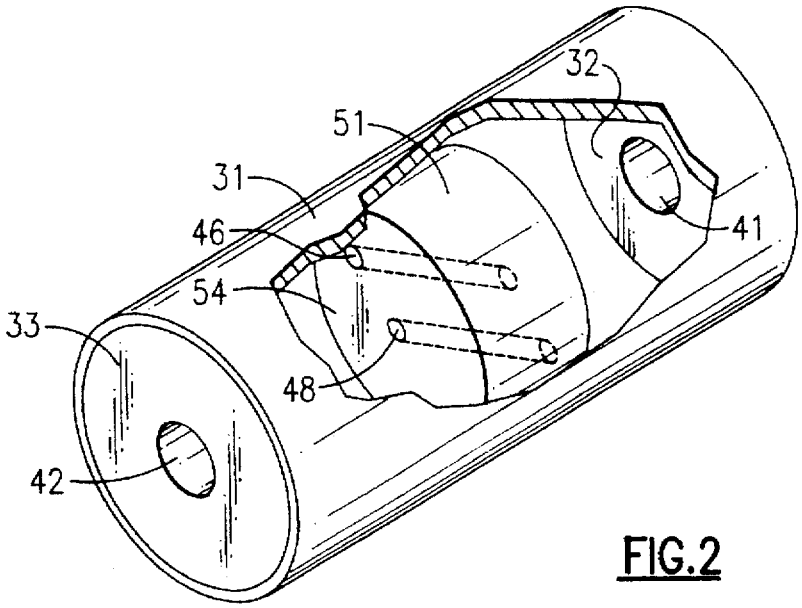
FIG. 2 is an isometric view in partial section of the flow control device of the present invention incorporated in the system illustrated in FIG. 1.

Referring to FIG. 2 the bidirectional flow control device of the present invention comprises a generally cylindrical body 31 with end walls 32 and 33 closing off the body to form internal chamber 34. The end walls 32 and 33 each have an aperture 41, 42 extending therethrough and axially aligned with each other and the body.

Figure 3:
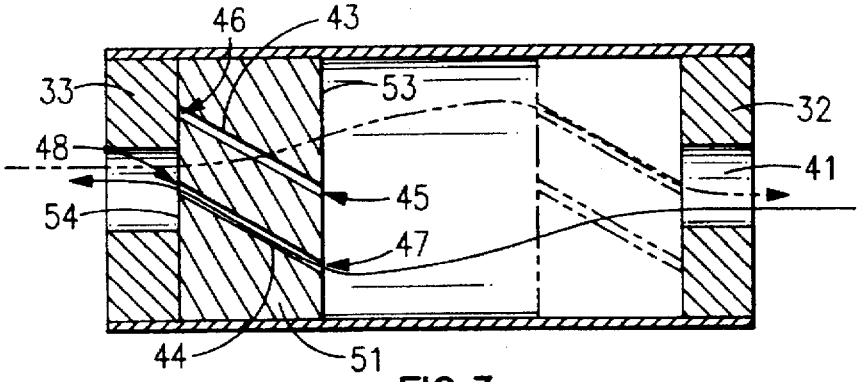
FIG. 3 is a plan view in section of the flow control device of the present invention incorporated in the system illustrated in FIG. 1.

A free floating piston 51 is coaxially disposed and slidably mounted within the internal chamber. The foreshortened piston is of a predetermined length, and is sized diametrically such that in assembly is permitted to slide freely in the axial direction within the internal chamber. The piston is provided with two flat and parallel end faces 53, 54. The left hand end face 54, as illustrated in FIG. 3, is adapted to arrest against end wall 33 of the internal chamber and the right hand end face 53 adapted to arrest against end wall 32. The piston has a cylindrical body having a pair of metering orifices extending therethrough. The metering orifice 43 has an outlet 45 and an inlet 46 arranged such that the outlet 45 is positioned at the approximate radial center of face 53 of the piston and the inlet 46 is positioned in the opposite face 54 radially outward of the radial center of the piston. Likewise the metering orifice 44 has an outlet 48 positioned at the approximate radial center of face 54 of the piston and an inlet 47 positioned in the opposite face 53 radially outward of the radial center of the piston. The inlets of each of the metering orifices are radially positioned such that they are closed off when the piston is arrested against the respective end wall. As shown in FIG. 3, the piston is arrested against end wall 33 and inlet 46 of metering orifice 43 is closed off from communicating with the chamber 34. The metering orifice 44 is sized properly to meter refrigerant fluid flow when the system 10 is operating in the cooling mode and the metering orifice 43 is properly sized for the heating mode.

In operation, the bidirectional flow control device 30, as shown in FIG. 1, controls the flow of refrigerant fluid flow between the heat exchangers 13, 14. When the system 10 is operating in the heating mode the fluid flow 15 moves as indicated from heat exchanger 13 to heat exchanger 14. Under the influence of the flowing refrigerant, the piston is moved to the left (when viewing FIG. 1) against end wall 33 and thereby closes off metering orifice 43. Refrigerant flows unrestricted through aperture 41, and is forced to pass through inlet 47 of metering orifice 44 to throttle the refrigerant from the high pressure side of the system to the low pressure side. Similarly, when the system is operated in the cooling mode the cycle is reversed and the refrigerant is caused to flow in the opposite direction, the piston is automatically moved to the right (when viewing FIG. 1) against end wall 32 whereby the refrigerant is properly metered through inlet 46 of metering orifice 43.

Figure 4:
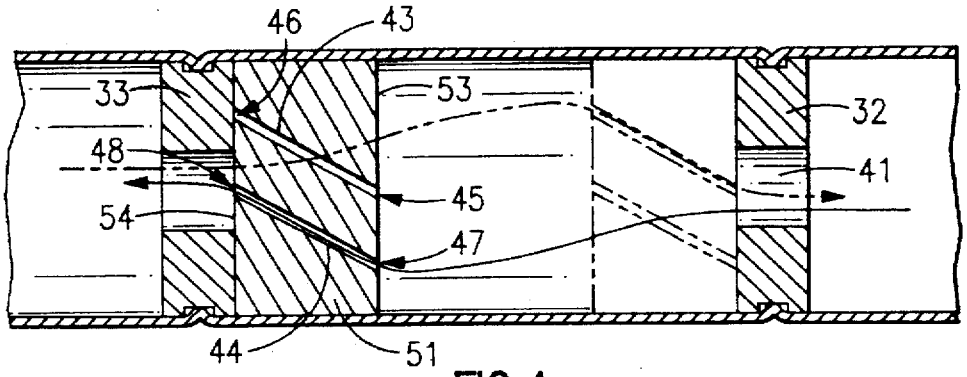
FIG. 4 is a plan view in section of another embodiment of the piston of the flow control device of the present.

An alternative design for the metering orifices in illustrated in FIG. 4. In this configuration the metering orifices 43A, 44A are axially disposed within the piston 51A. The inlets 46A and 47A are positioned radially outward of the center of the piston in the end faces 54A, 53A and adapted to come into contact and close off against end walls 32 and 33 when the piston is urged by fluid flow in either direction. The outlets 45A and 48A are positioned in end faces 53A, 54A and sized such that they provide communication between the metering orifice and the corresponding aperture in the end wall in the direction of fluid flow.

Device 30 may be configured in several variations. It may be sized so that its outer diameter is slightly smaller than the inner diameter of the tube that connects heat exchangers 13 and 14. During manufacture of the system, device 30 is inserted into the tube and the tube is crimped near both end walls 32 and 33 so that the device cannot move within the tube. Alternatively, the device can be manufactured with threaded or braze fittings, not shown, at both ends so that it may be assembled into the connecting tube using standard joining techniques.

Figure 5:
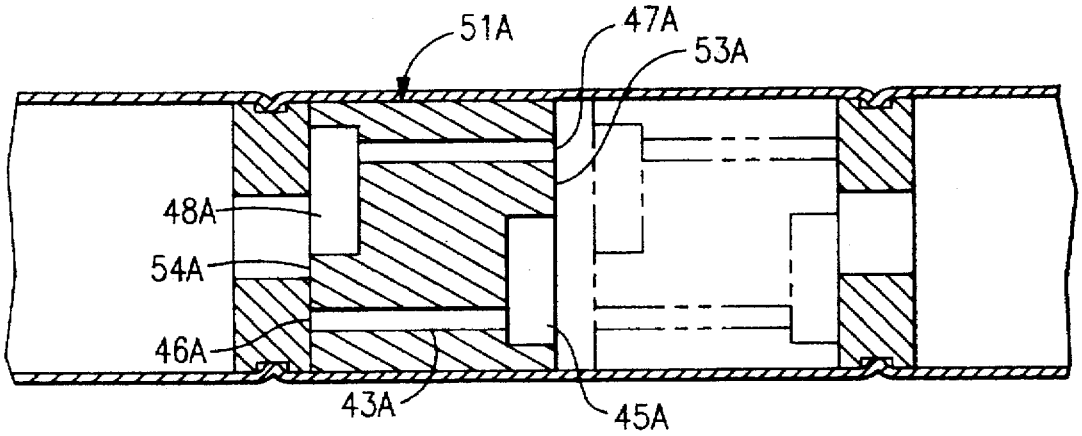
FIG. 5 is a plan view in section of another embodiment of the flow control device of the present invention.

Still another configuration is shown in FIG. 5. In that embodiment, tube 61 forms the cylindrical side wall of device 30A. End walls 32A and 33A, with free piston 51 between them, are inserted into tube 61. End walls 32A and 33A are similar in construction to end walls 32 and 33, each respectively having an aperture 41 and 42. In addition, each of end walls 32A and 33A has a circumferential notch around its periphery. FIG. 8 shows circumferential notch 46 around end wall 33A. With end walls 32A and 33A and piston 51 properly positioned with respect to each other, tube 61 is crimped. The crimping creates depressions 62 into notches 46 that prevent the end walls from moving within the tube.

A bidirectional flow control device similar to that shown in FIG. 2 has been tested. The device was configured for a heat pump system having a 1.5 ton capacity and a nominal tube diameter of 0.25 to 0.38 inches, although the invention could conceivably be configured for any size system. The mass flow rates for the refrigerant, R22, in the cooling and heating modes were about 290 pounds per and about 130 pounds per hour respectively. In this configuration the piston width was 0.340 inches and the length of each of the metering orifices was 0.378 inches. The diameter of the metering orifice for the cooling mode was 0.053 inches and the diameter of the metering orifice for the heating mode was 0.049 inches.

What is claimed is:

1. A device for controlling the flow of a fluid in a conduit in a first and second direction comprising:

an elongated body having a first end wall and a second end wall defining an internal chamber therebetween;

the first end wall having an aperture axially extending therein and in communication with the internal chamber;

the second end wall having an aperture axially extending therein and in communication with the internal chamber;

a piston disposed in the internal chamber and being slidably movable axially between a first position and a second position in response to fluid flow, the piston having a first end face parallel to the first end wall and a second end face parallel to the second end wall, and further having a first metering orifice and a second metering orifice extending therebetween;

the first metering orifice having an outlet disposed in the first end face and configured to communicate with the aperture in the first end wall and an inlet disposed in the second end face configured to communicate with the internal chamber in the first position and close against the second end wall in the second position;

the second metering orifice having an outlet disposed in the second end face and configured to communicate with the aperture in the second end wall and an inlet disposed in the first end face configured to communicate with the internal chamber in the second position and close against the first end wall in the first position;

whereby the piston establishes communication through the metering orifice in the direction of the fluid flow.

2. The device as set forth in claim 1 wherein the first metering is of a different size than the second metering orifice.

3. The device as set forth in claim 1 wherein the first and second end walls are disposed within the conduit.

4. A reversible vapor compression air conditioning system having a compressor, a first heat exchanger and a second heat exchanger being selectively connected to the compressor, switching means for selectively connecting the inlet and discharge side of the compressor between the exchanger and a refrigerant supply line for delivering refrigerant from one exchanger to the other, comprising:

a flow control device mounted in the supply line between each exchanger having an elongated body having a first end wall and a second end wall defining an internal chamber therebetween;

the first end wall having an aperture axially extending therein and in communication with the internal chamber;

the second end wall having an aperture axially extending therein and in communication with the internal chamber;

a piston disposed in the internal chamber and being slidably movable axially between a first position and a second position in response to fluid flow, the piston having a first end face parallel to the first end wall and a second end face parallel to the second end wall, and further having a first metering orifice and a second metering orifice extending therebetween;

the first metering orifice having an outlet disposed in the first end face and configured to communicate with the aperture in the first end wall and an inlet disposed in the second end face configured to communicate with the internal chamber in the first position and close against the second end wall in the second position;

the second metering orifice having an outlet disposed in the second end face and configured to communication with the aperture in the second end wall and an inlet disposed in the first end face configured to communicate with the internal chamber in the second position and close against the first end wall in the first position;

whereby the piston establishes communication through the metering orifice in the direction of the fluid flow and permits the fluid to flow into the supply line.

5. A reversible vapor compression air conditioning system as set forth in claim 4 wherein the supply line comprises the elongated body.

* * * * *